US007467438B2

(12) United States Patent
Ryman

(10) Patent No.: US 7,467,438 B2
(45) Date of Patent: Dec. 23, 2008

(54) BARE BACK SCRUBBER

(76) Inventor: Therese A. Ryman, 15824 Griffon Path, Apple Valley, MN (US) 55124

( * ) Notice: Subject to any disclaimer, the term of this patent is extended or adjusted under 35 U.S.C. 154(b) by 414 days.

(21) Appl. No.: 11/295,581

(22) Filed: Dec. 7, 2005

(65) Prior Publication Data

US 2006/0117513 A1 Jun. 8, 2006

Related U.S. Application Data

(60) Provisional application No. 60/633,729, filed on Dec. 7, 2004.

(51) Int. Cl.
*A47K 7/02* (2006.01)

(52) U.S. Cl. ..... 15/244.3; 15/160; 15/210.1; 15/244.1; 15/167.3; 4/606

(58) Field of Classification Search ..... 15/244.3, 15/160, 210.1, 244.1, 167.3; 4/606
See application file for complete search history.

(56) References Cited

U.S. PATENT DOCUMENTS

| | | | | |
|---|---|---|---|---|
| 1,639,366 | A | 8/1927 | Brown | |
| 3,612,044 | A * | 10/1971 | Gurrola | 601/136 |
| 3,631,560 | A | 1/1972 | Atkins | |
| 3,750,226 | A | 8/1973 | Morgan | |
| 4,053,960 | A | 10/1977 | Kingswell | |
| D260,563 | S | 9/1981 | Walsh, Jr. | |
| 4,417,362 | A | 11/1983 | Walker | |
| D283,261 | S | 4/1986 | Walling | |
| 4,696,068 | A | 9/1987 | Kenner | |
| 4,704,759 | A | 11/1987 | Mesa | |
| 4,943,018 | A | 7/1990 | Glaser et al. | |
| D330,977 | S | 11/1992 | Otis | |
| 5,175,896 | A * | 1/1993 | Zamir | 4/606 |
| 5,228,165 | A | 7/1993 | Westberry et al. | |
| 5,277,389 | A | 1/1994 | Ballares et al. | |
| D344,633 | S | 3/1994 | Ali | |
| 5,311,635 | A | 5/1994 | Moore | |
| 5,600,864 | A | 2/1997 | Huber | |
| 5,628,083 | A | 5/1997 | Hayes | |
| D388,547 | S | 12/1997 | Walls | |
| 5,779,653 | A | 7/1998 | Thompson | |

(Continued)

FOREIGN PATENT DOCUMENTS

| | | | |
|---|---|---|---|
| GB | 2 216 000 | A | 10/1989 |

(Continued)

*Primary Examiner*—Shay L Karls
(74) *Attorney, Agent, or Firm*—Richard C. Litman

(57) ABSTRACT

The bare back scrubber is a wall mountable device that includes a pad and a stand with legs and a faceplate. The pad is made of extra virgin polyester fibers; the polyester fibers are diffusely spread on top of each other forming a permeable and airy mat. The pad is removably attached to the stand by fasteners. The fasteners are fixed to the faceplate. The stand will ideally have five legs; four disposed at each corner of the faceplate and one disposed in the middle of the faceplate. The faceplate will be flat and have a thickness. A cloth may be disposed over the faceplate and pad to aid in applying lotions, creams or other liquid-type substances. The cloth will be fitted and be removably disposed over the faceplate and the pad so it can be laundered when soiled.

9 Claims, 9 Drawing Sheets

U.S. PATENT DOCUMENTS

| | | | |
|---|---|---|---|
| 5,784,722 | A | 7/1998 | Ureta et al. |
| 5,822,824 | A | 10/1998 | Dion |
| D400,658 | S | 11/1998 | Mejia, Sr. |
| 6,370,722 | B1 | 4/2002 | Duckworth |
| 6,427,279 | B1 | 8/2002 | White, Jr. et al. |
| 6,526,618 | B1 | 3/2003 | Bolton |
| 6,647,564 | B1 | 11/2003 | Smith |
| 2002/0117185 | A1 | 8/2002 | Simon et al. |

FOREIGN PATENT DOCUMENTS

| | | | |
|---|---|---|---|
| GB | 2 375 478 | A | 11/2002 |

* cited by examiner

BARE BACK SCRUBBER

CROSS-REFERENCE TO RELATED APPLICATION

This application claims the benefit of U.S. Provisional Patent Application Ser. No. 60/633,729, filed Dec. 7, 2004.

BACKGROUND OF THE INVENTION

1. Field of the Invention

The present invention relates to hygiene devices and, more particularly, to wall mounted back scrubbers.

2. Description of the Related Art

The difficulty in washing one's back is realized by the number of bath items devised for scrubbing and cleansing one's back. For instance, abrasive gloves help in exfoliating and washing the back, but they require one to stretch in order to reach their back. Loofahs, bristles or sponges disposed on long handles or strung to a rope are intended to help individuals reach areas on the back that cannot be easily reached by stretching. However, these long handled devices will not help inflexible individuals nor individuals unable to adequately use their arms to reach their backs. Many of the long handled devices are not ergonomic and are difficult to hold on to and the loofah and sponges used can become moldy and develop an unpleasant color and odor.

A device is desired that can be used in the bath without using one's hands. The device should be able to withstand wear and should be able to withstand the formation and growth of mold, by being able to circulate air throughout. The device should be abrasive enough to exfoliate yet not excessively abrasive on the skin. It would be further desirable to have a removably attachable accessory that can be disposed on the device to aid in applying lotions or medications to the back area without using one's hands.

SUMMARY OF THE INVENTION

The bare back scrubber is a wall mountable device that includes a scrub pad and a stand comprising legs and a faceplate. The pad is made of extra virgin polyester fibers; the polyester fibers are diffusely spread on top of each other, forming a permeable and airy mat. The pad is removably attached to the stand by fasteners such as hook material. The hook material is fixed to the faceplate which will removably grip the diffusely spread polyester fibers of the pad.

The hook material may be disposed on the faceplate in strips. Two strips may be used with each strip extending from the front to the back of the faceplate. In one embodiment, the strips of hook material are about eighteen inches long, and are set in from the sides and up from the bottom edges of the faceplate. Alternatively, the hooks can be molded integrally with the faceplate to removably receive the pad.

The stand has five legs; four disposed at each corner of the faceplate and one in the middle of the faceplate. The faceplate and legs may be made by injection molded, sturdy rigid plastic, or other material that should not rust or discolor. The position of the five legs provides greater weight-bearing ability than just four legs. Suction cups are disposed at the ends of the legs farthest from the faceplate to removably anchor the stand to a bathtub and shower wall. The faceplate is flat, and has a predetermined thickness.

A cloth may be disposed over the faceplate and pad to aid in applying lotions, creams or other liquid-type substances. The cloth has sufficient dimensions to cover both the faceplate and the pad. The cloth is fitted and removably disposed over the faceplate and the pad. The cloth can be laundered when soiled.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
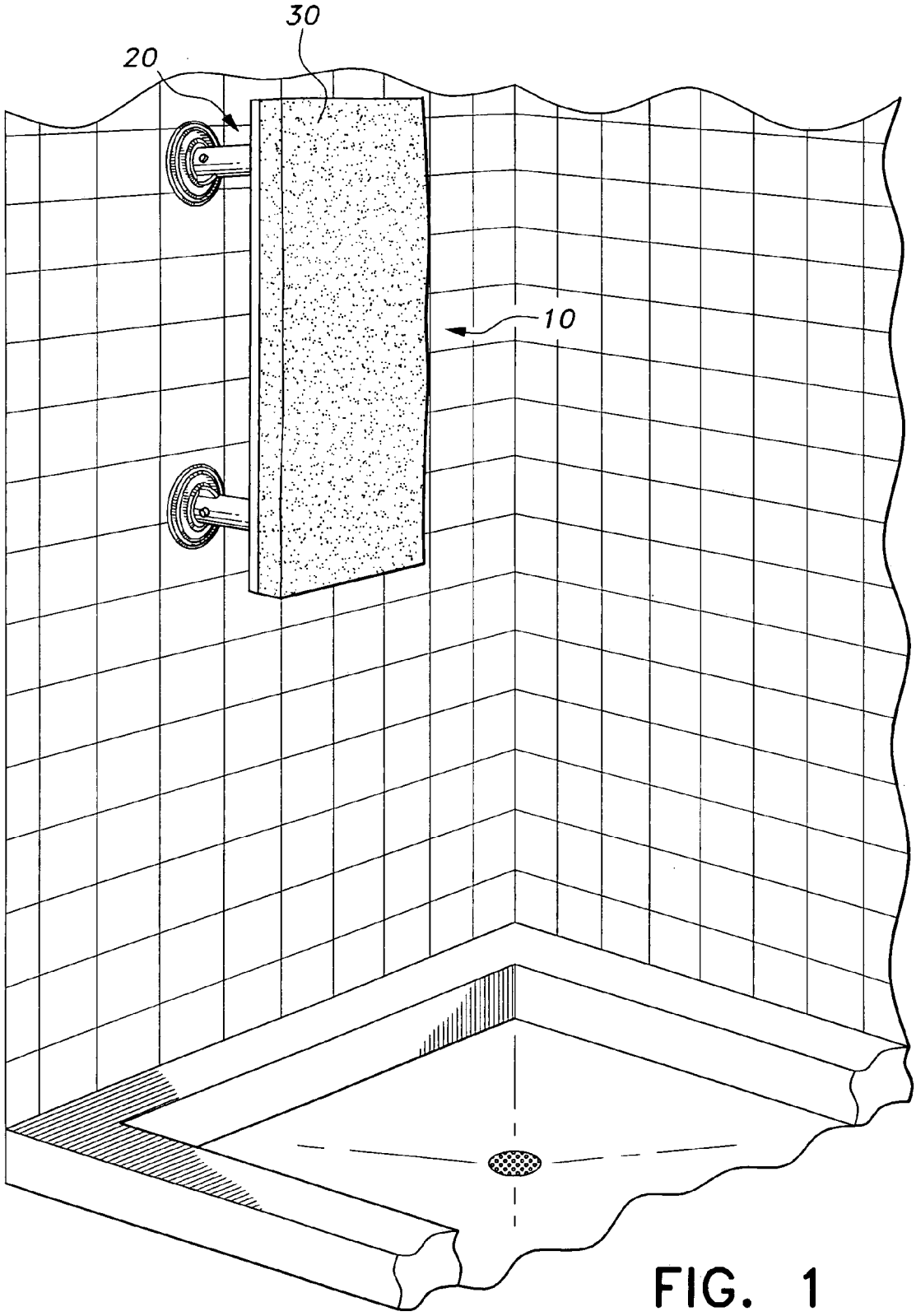
FIG. 1 is an environmental, perspective view of a bare back scrubber according to the present invention.
Figure 2:
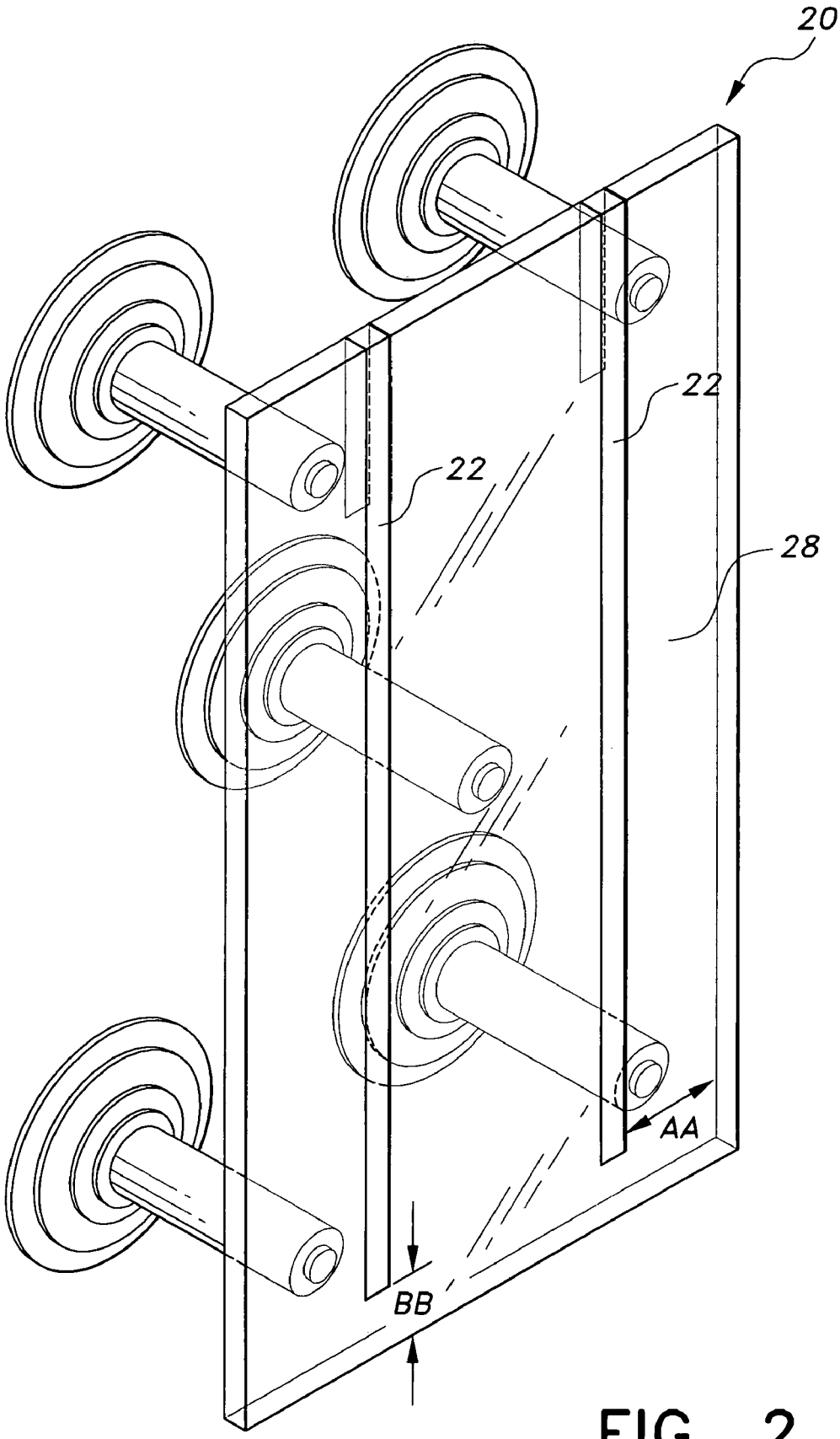
FIG. 2 is a front, perspective view of the stand.
Figure 3:
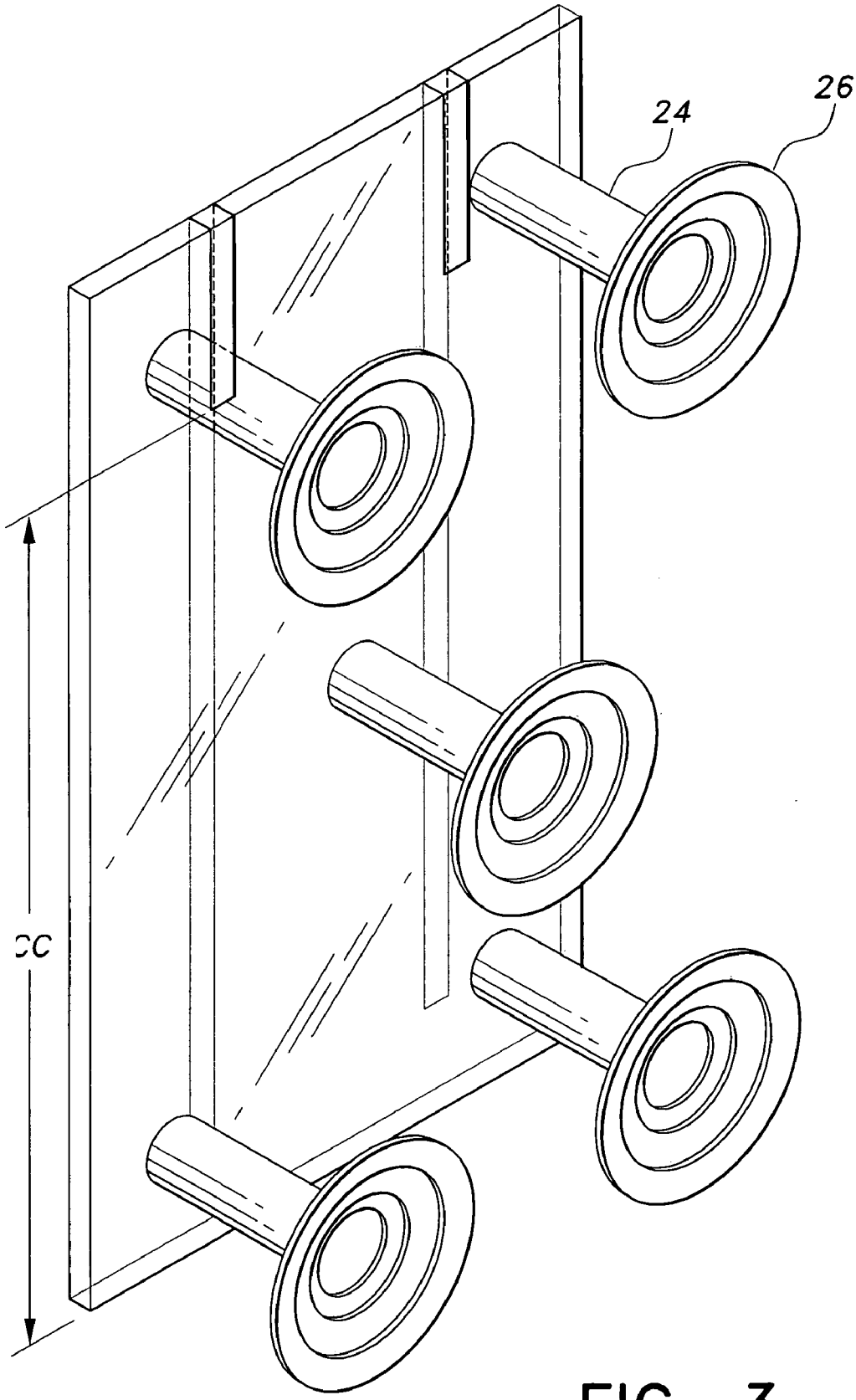
FIG. 3 is a rear, perspective view of the stand.

A bare back scrubber is designated as 10 in the drawings. As shown in FIG. 1, the scrubber 10 is a wall mountable device comprising a pad 30, such as a scrub pad, and a stand 20. Referring to FIGS. 2 and 3, the stand 20 comprises a faceplate 28, legs 24 and suction cups 26 disposed at the end of the legs 24 opposite the faceplate 28.

Fasteners 22 are used to removably attach the pad 30 to the stand 20. Ideally, hook material is used to fasten the pad 30 to the faceplate 28; however other fasteners may be used. The fasteners 22 are fixed to the faceplate 28 to removably receive the pad 30. If the type of fastener 22 used is hook material, it will be disposed on the faceplate 22 in strips with the strips extending from the front to the back of the faceplate 28. Ideally, two strips of hook material would be used on the scrubber 10; however one or more than two could be used as well. The strips of hook material are made of industrial-strength waterproof hook-type fasteners, sold under the VELCRO trademark.

If strips of hook material are used as the fastener 22 type for the scrubber 10, the strips are about eighteen inches long and two inches wide. The strips are set in a distance AA from the sides and up a distance BB and CC from the bottom edges of the faceplate 28, as shown in FIGS. 2 and 3. Distance AA is set in from the sides at about one and a half inches to two inches. Distance BB is the distance between the bottom edge of the front surface of the faceplate 28 to the start of the strips on the front surface. Distance CC is the distance between the bottom edge on the rear surface of the faceplate 28 to the end of the strips. The hook material, therefore, is disposed the distance AA from the sides the distance BB from the bottom edge of the front surface of the faceplate 28. The strips then extend up the length of the front surface and over the top to the rear surface, ending at a distance CC from the rear bottom edge of the faceplate 28. Distance BB would be about one and a half inches from the bottom edge; distance CC could be a greater distance than the distance BB.

The positioning of the strips of hook material on the faceplate 28 can take any form. However, the above-described position of the strips of hook material is ideal in helping keep the pad 30 on the faceplate 28, by making it difficult for water to pool or get trapped between the strips and the faceplate 28, which might cause the strips to come loose. The hook material is made of industrial-strength waterproof material, and is fixed to the faceplate 28 with industrial-strength waterproof adhesive. Alternatively, the hooks may be molded integrally in the front of the face plate to removably receive the pad 30.

Legs 24 extend from the rear of the faceplate 28. Legs 24 are disposed at the four corners of the faceplate 28, and one leg 24 is located in the middle of the faceplate 28. The legs 24 disposed at the corners are about one and a half inches in from the sides. The positioning of the middle leg 24 in the middle of the faceplate 28 provides greater weight-bearing ability than just placing the legs 24 at the corners of the faceplate 28. The arrangement of the legs permits the scrubber 10 to better withstand force applied by heavy users as opposed to the force applied by lighter users.

The legs 24 may be of any appropriate length, and in one embodiment, they are about three and a half inches long. The legs 24 dispose the faceplate 28 at a distance from the bathtub and/or shower wall, thereby allowing the user to use the front and edges of the scrubber 10. The legs 24 allow the user to use the scrubber 10 without having to be up against the shower wall. Suction cups 26 are disposed at the ends of the legs 24 which are farthest from the faceplate 28. The suction cups 26 may be tightly secured to the end of the legs 24 to provide a rigid surface to maneuver upon or loosely held in a "floating" manner to permit the scrubber 10 to slightly move in response to the motion of pressure applied by the user. The suction cups 26 removably anchor the stand 20 to the bathtub and/or shower wall. The faceplate 28 is flat and has a pre-determined thickness.

The faceplate 28 and legs 24 are made of sturdy rigid plastic that should not rust or discolor. Ideally, the type of plastic used to make the stand 20 is acrylonitrile butadiene styrene (ABS) plastic, polyethylene or polycarbonate; however other plastics may also be used. The faceplate 28 and legs 24 may be made in pieces and joined together, or they may be made as one piece by injection molding. Stress lines may be molded into the rear surface of the faceplate 28 to provide added strength and durability.

The pad 30 is made of extra virgin polyester fibers that, when used properly, can gently exfoliate the skin. The pad 30 comprises of fibers that are diffusely spread on top of each other forming a permeable mat. The pad 30 may be made to have any density. The diffuse arrangement of the fibers lends itself to allow hook material to readily serve as the type of fastener disposed on the faceplate 28 to removably attach the pad 30 to the stand 20. The hook material is fixed to the faceplate which removably grips the diffusely spread polyester fibers of the pad 30.

In use, the user should clean the surface on which the scrubber 10 would be applied to remove any soap scum, oil or other debris. Then the user mounts the scrubber 10 to the wall or other vertical surface by first grasping the two top legs 24 and pressing them firmly to the wall, followed then by the two bottom legs 24 and the middle leg 24. To remove the scrubber 10, the two bottom legs 24 are removed, followed by the middle leg 24 and then the top legs 24.

The pad 30 can be lathered in any conventional manner, for example, by wetting and rubbing soap directly on the pad 30. The pad 30 can be rinsed off while remaining on the stand 20, or by removing the pad 30 from the stand 20. The pad 30 should be removed by pulling the topmost end of the pad 30 away from the faceplate 28. Likewise, the pad 30 can be dried in place on the stand 20 or by removing it from the stand 20 and laying it out horizontally.

Figure 4:
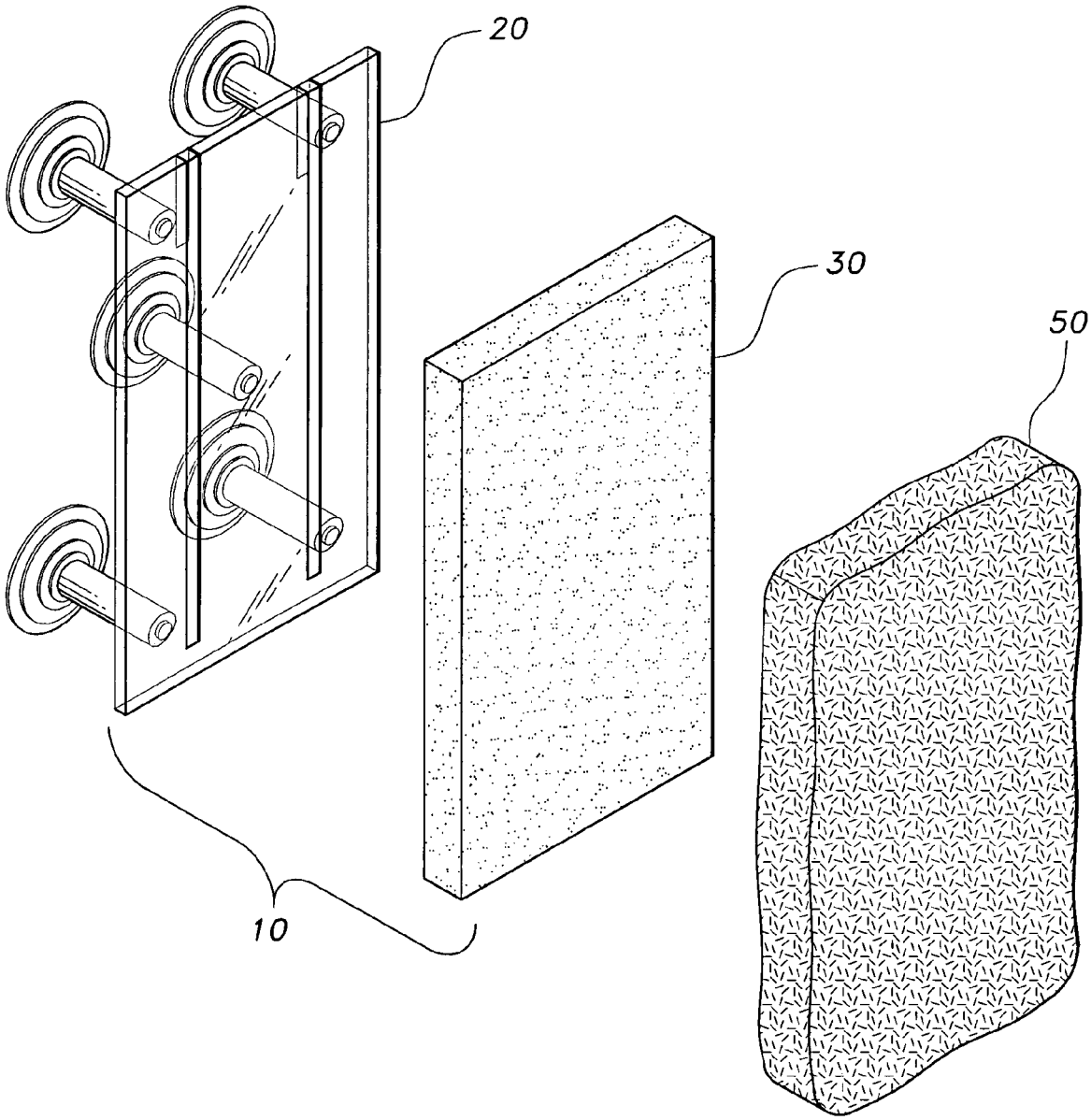
FIG. 4 is an exploded view of the bare back scrubber cover.
Figure 5:
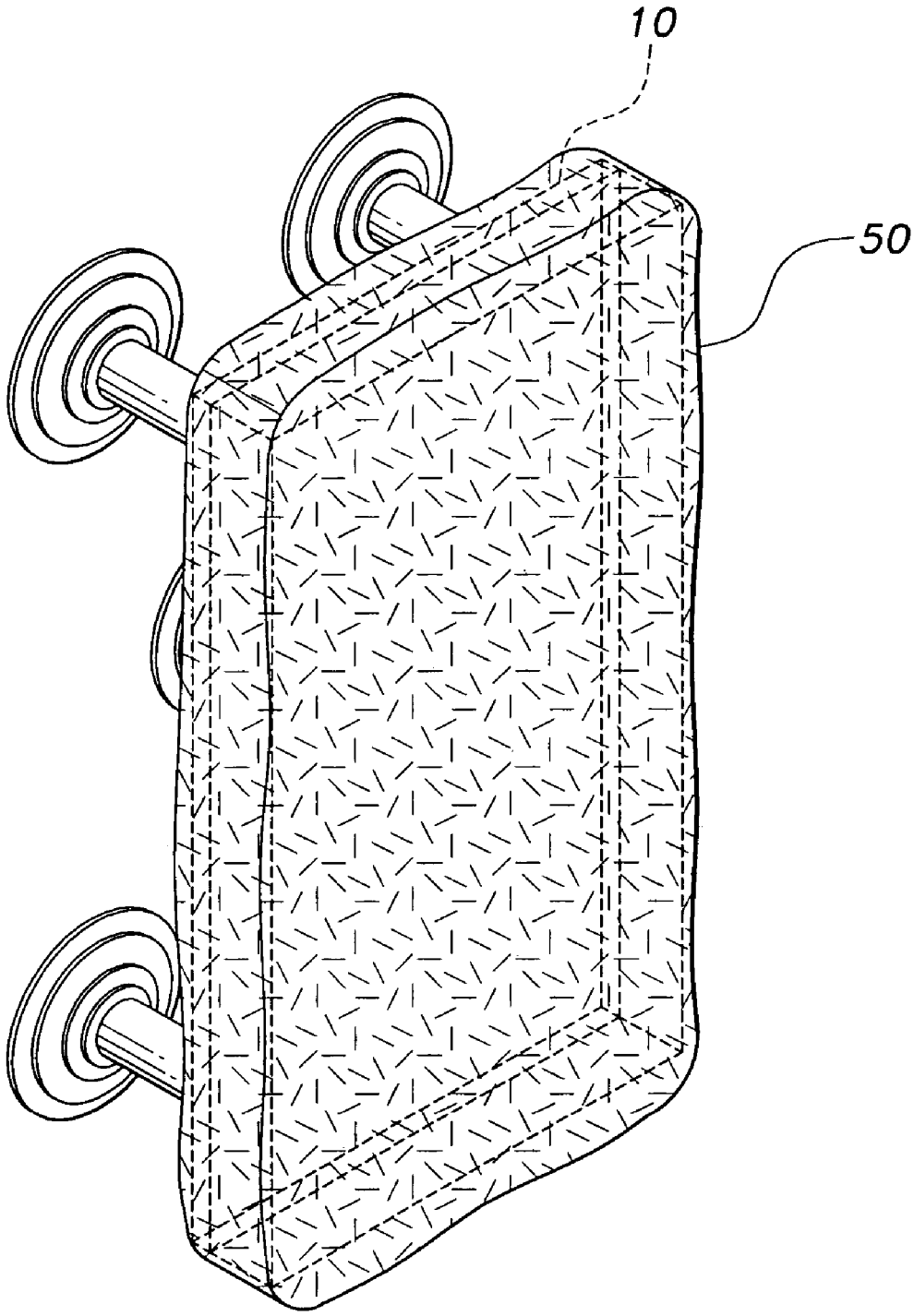
FIG. 5 is a front, perspective view of the bare back scrubber and the fitted terry cloth cover disposed over both the pad and the faceplate.

Looking now to FIGS. 4 and 5, a cloth 50 may be disposed over the bare back scrubber 10 to aid in applying lotions, creams or other liquid-type substances. The cloth 50 may be made of any conventional material, for example, small loop cotton terrycloth. The cloth 50 is of a sufficient width to envelop both the faceplate 28 and the pad 30 and is lined with a cotton chintz material to prevent snagging on the hook material. The cloth 50 is fitted to be removably disposed over the faceplate 28 and the pad 30. The cloth 50 is used by directly applying the lotion, ointment or liquid material directly on the cloth and then the user moves vertically or horizontally about the scrubber 10. Alternatively the user can drip lotion, ointment or liquid material directly down their back and rub against the cloth 50 to distribute the creams on their back.

The cloth 50 can be laundered when soiled or when needed. The cloth 50 may be made of any material such as terry cloth. The cloth 50 has elastic at its opening to expand and contract when needed and easily remain and be removed from the scrubber 10. The scrubber 10 is shown as a rectangle, but may take any shape such as hourglass, round, oval or square. The cloth 50 can be made to match the shape of the scrubber 10.

Figure 6:
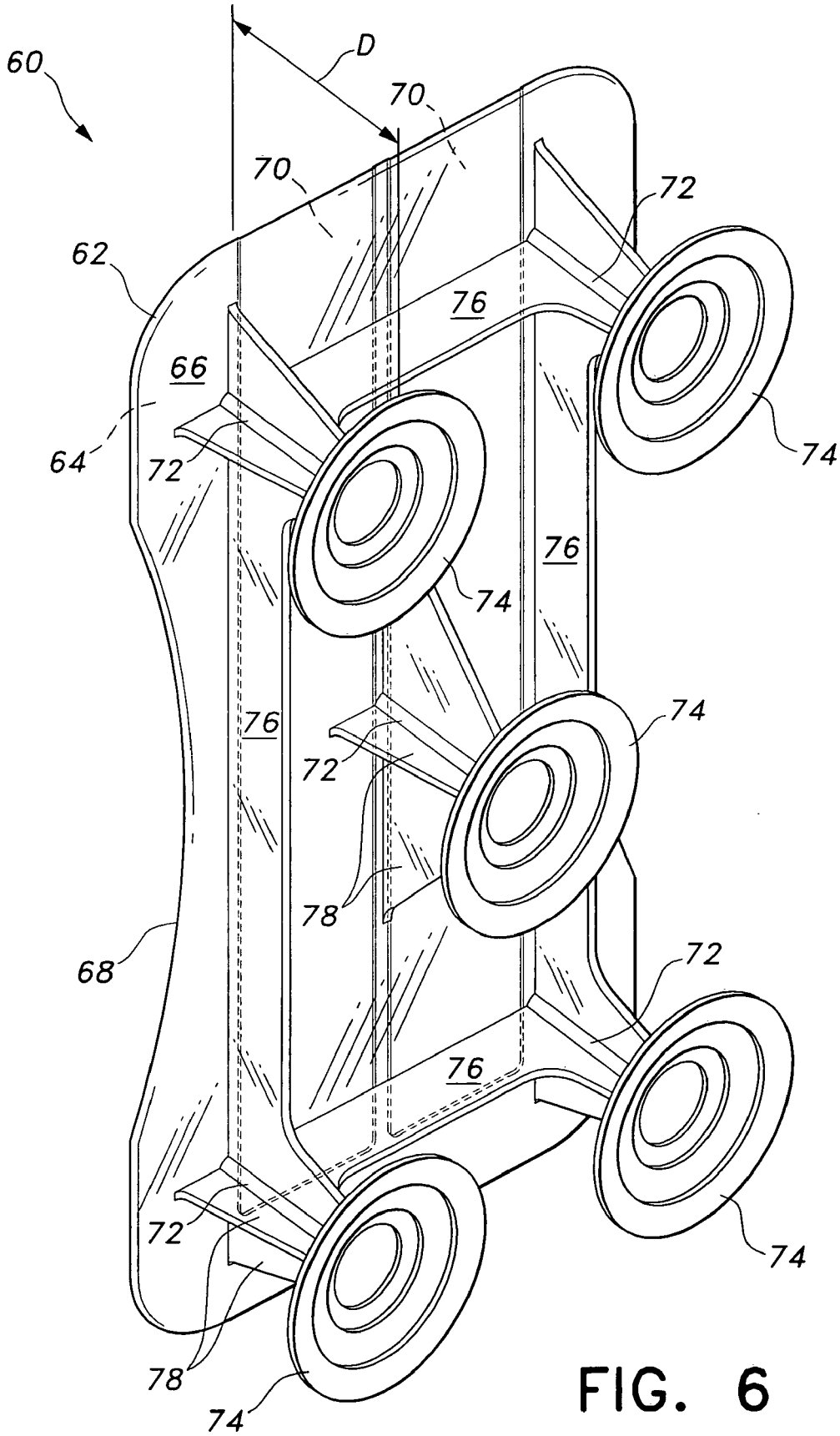
FIG. 6 is a rear, perspective view of an alternative embodiment of the bare back scrubber.
Figure 7:
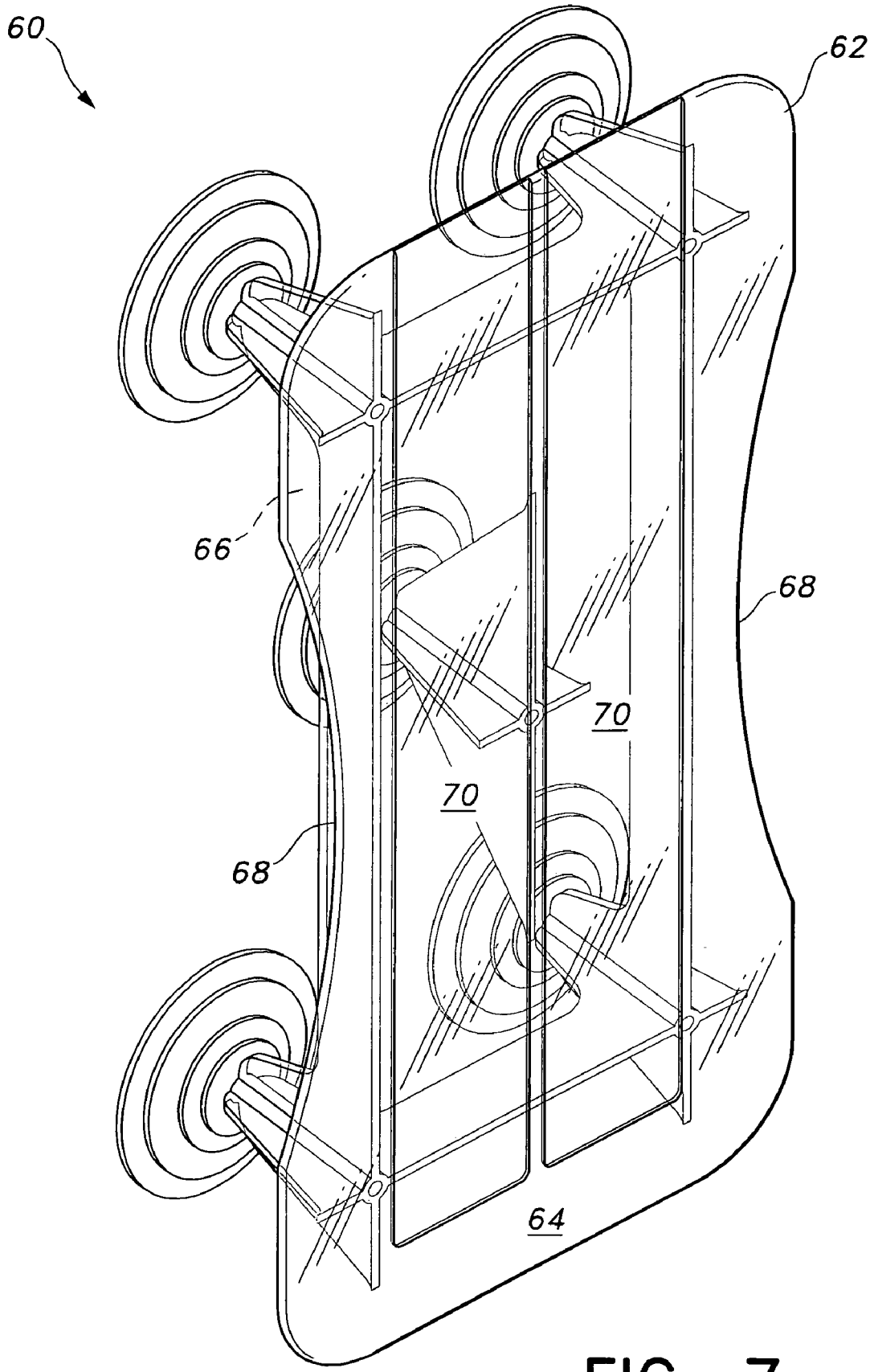
FIG. 7 is a front, perspective view of an alternative embodiment of the bare back scrubber.

A second embodiment of the invention is shown in FIGS. 6-7. A scrubbing stand 60 is shown in this embodiment without a scrubbing pad for illustrative purposes only. A pad of similar composition to pad 30 and a cloth of similar composition to cloth 50 as previously described hereinabove may be used for scrubbing stand 60. Scrubbing stand 60 comprises a supporting board 62 having a front face 64 and a rear face 66. An arcuate cutout 68 is disposed along both vertical sides of the supporting board wherein a scrubbing pad or a scrubbing pad and cloth may be geometrically conformed to the shape of the supporting board 60. The arcuate cutout 68 allows for contoured scrubbing by a user superior to that of a vertical straight edge. Recessed attachment channels 70 are formed in the front face 64 of support board 62 for receiving one portion of a hook and loop fastening material that attaches to the rear side of a scrubbing pad.

Support legs 72 in this embodiment are integrally attached to the rear face 66 of support board 62 at a first end, and suction cups 74 are attached to support legs 72 at a second opposite end. The combination of support legs 72 and suction cups 74 enable the support board 62 to extend a distance D from a vertical wall wherein the suction cups 74 may be attached. The distance D is optimally configured to be between 2.5 and 3 inches to allow the support board 62 and the attached scrubbing pad or scrubbing pad and cloth to extend out between 2.5 and 3 inches when mounted on a vertical shower wall allowing a user to use the scrubbing stand when standing in a bathtub.

Reinforcing ribs 76 are integrally connected to the support legs 72 on the rear face 66 of support board 62. The ribs 76 may be continuous as shown or formed in segments. Additionally, reinforcing leg extensions 78 project outwardly from support legs 72 and are tapered in the direction from the rear face 66 toward the suction cups 74. The support legs 72 located on the peripheral edges of support board 62 have two reinforcing leg extensions integrally connected to a reinforcing rib 76. The centrally located support leg 78 may have reinforcing leg extensions 78 tapering over a greater distance such that the reinforcing leg extensions 78 may operate in a similar capacity to reinforcing ribs 76. The combination of reinforcing ribs 76 and reinforcing leg extensions 78 allow support board 62 to better distribute the force of a user when contacting a scrubbing pad or scrubbing pad and cloth when attached to the wall mounted support board 62.

Figure 8:
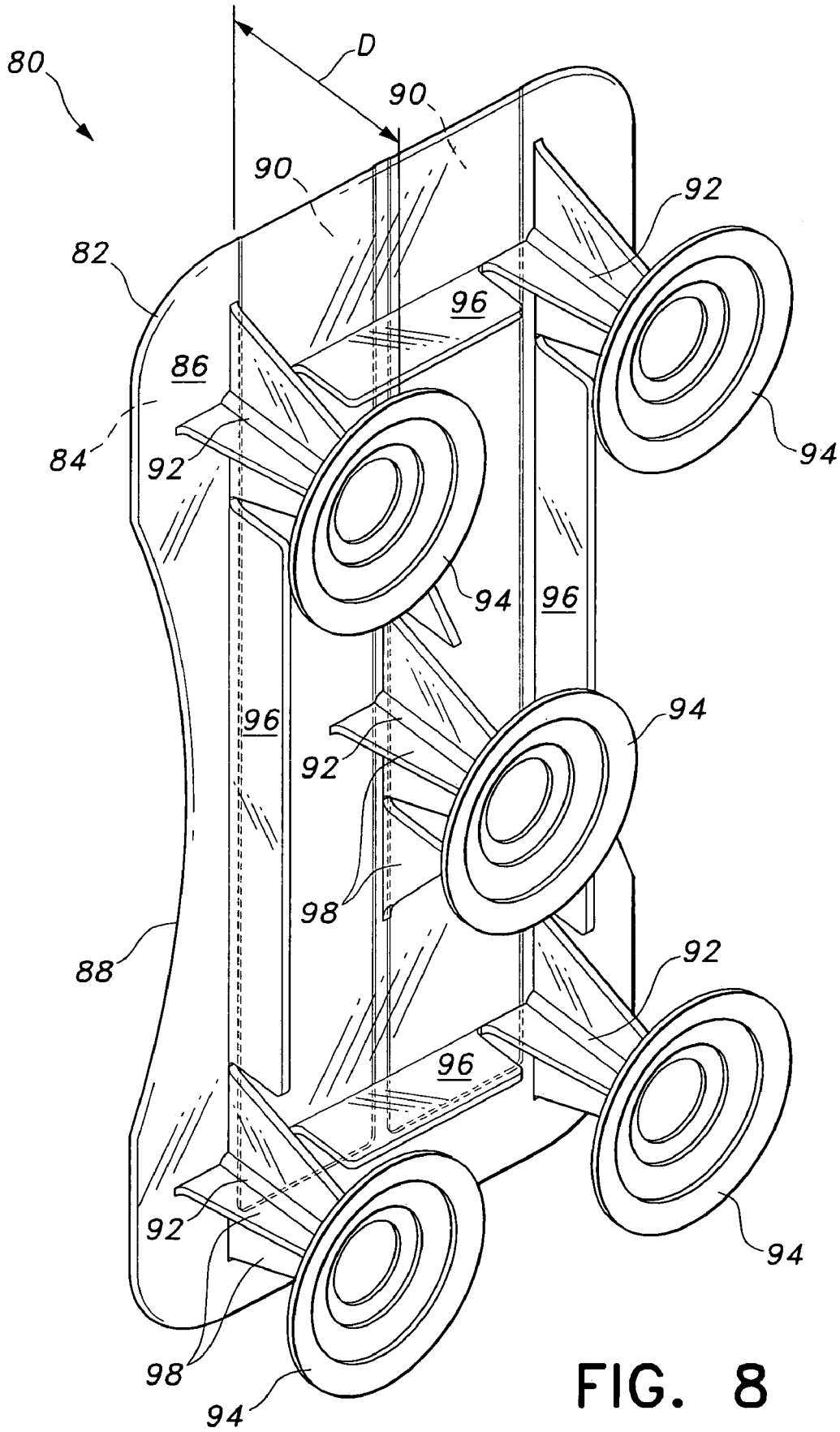
FIG. 8 is a rear, perspective view of an additional alternative embodiment of the bare back scrubber.
Figure 9:
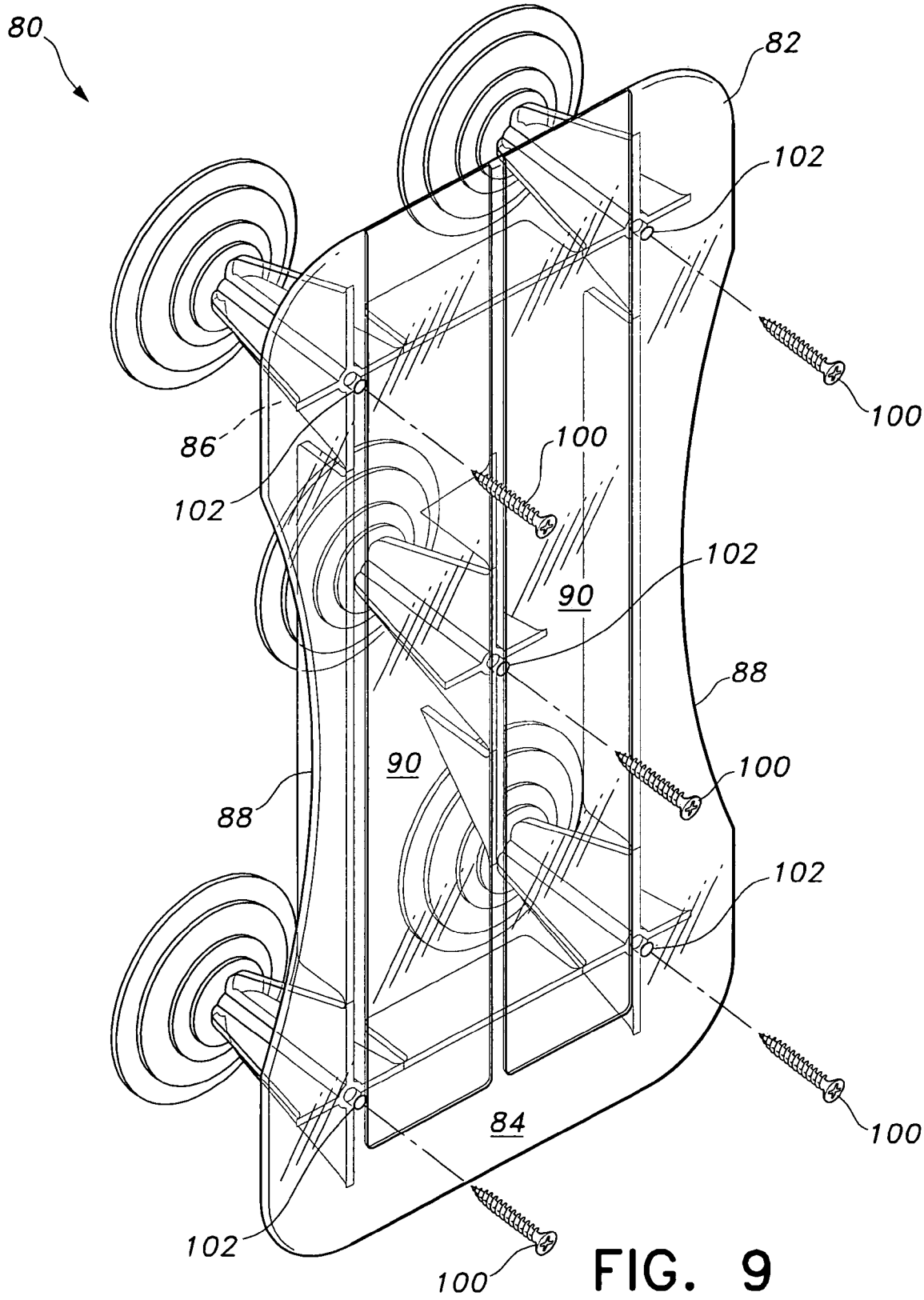
FIG. 9 is front, perspective view of an additional alternative embodiment of the bare back scrubber.

A third embodiment of the invention is shown in FIGS. 8-9. A scrubbing stand 80 is shown in this embodiment without a scrubbing pad for illustrative purposes only. A pad of similar composition to pad 30 and a cloth of similar composition to cloth 50 as previously described hereinabove may be used for scrubbing stand 80. Scrubbing stand 80 comprises a supporting board 82 having a front face 84 and a rear face 86. An arcuate cutout 88 is disposed along both vertical sides of the supporting board wherein a scrubbing pad or a scrubbing pad and cloth may be geometrically conformed to the shape of the supporting board 80. The arcuate cutout 88 allows for contoured scrubbing by a user superior to that of a vertical straight edge. Recessed attachment channels 90 are formed in the front face 84 of support board 82 for receiving one portion of a hook and loop fastening material that attaches to the rear side of a scrubbing pad.

Support legs 92 in this embodiment are removably attached to the rear face 86 of support board 82 at a first end, and suction cups 94 are attached to support legs 92 at a second opposite end. The support legs 92 are attached to the rear face 86 of support board 82 by means of fasteners 100 projecting through the front face 84 of support board 82 into fastening holes 102 for attachment to the support legs 92. The fastening holes 102 may have the screw threads molded therein or formed therein after molding. Further, if desired, the fasteners 100 may also be used to secure the suction cups 84 to the support legs 92. The combination of support legs 92 and suction cups 94 enable the support board 82 to extend a distance D from a vertical wall wherein the suction cups 94 may be attached. The distance D may be at any distance, but is optimally configured to be between 2.5 and 3 inches to allow the support board 82 and the attached scrubbing pad or scrubbing pad and cloth to extend out between 2.5 and 3 inches when mounted on a vertical shower wall allowing a user to use the scrubbing stand when standing in a bathtub. Optimally, this allows a user to stand in the flat portion of the bathtub at a safe distance from the shower wall.

Reinforcing ribs 96 are integrally connected to the rear face 86 of support board 82. Additionally, reinforcing leg extensions 98 project outwardly from support legs 92 and are tapered in the direction from the rear face 86 toward the suction cups 94. The combination of reinforcing ribs 96 and reinforcing leg extensions 98 allow support board 82 to better distribute the force of a user when contacting a scrubbing pad or scrubbing pad and cloth when attached to the wall mounted support board 82.

It is to be understood that the present invention is not limited to the embodiments described above, but encompasses any and all embodiments within the scope of the following claims.

I claim:

1. A back scrubber for mounting to a vertical surface, comprising:

a rigid support board having a flat front surface, a rear surface, a top peripheral edge, a bottom peripheral edge and side peripheral edges;

a plurality of support legs integrally attached to and extending from the rear surface of said support board, said plurality of support legs including at least two upper support legs spaced apart and disposed inward from the top peripheral edge, at least two lower support legs spaced apart and disposed inward from the bottom peripheral edge and at least one center support leg disposed in a central area of the rear surface of said support board;

a plurality of suction cups, each attached to said plurality of support legs at a distal end opposite the rear surface of said support board;

a plurality of reinforcing ribs projecting from and integral with the rear surface of said support board, said plurality of reinforcing ribs including two horizontal reinforcing ribs and two vertical reinforcing ribs, said horizontal reinforcing ribs extending between and connecting respective said upper and lower support legs, one of said reinforcing ribs extending between and connecting said upper support legs and said other of said vertical reinforcing ribs extending between and connecting said lower support legs;

at least one strip of hook fastening material affixed to the front surface of said support board; and a scrubbing pad removably attached to the front surface of said support board by said at least one strip of hook fastening material.

2. The back scrubber according to claim 1, wherein said support board has an arcuate cutout on each of the side peripheral edges.

3. The back scrubber according to claim 1, wherein each of said plurality of support legs has a plurality of radially extending reinforcing leg extensions tapering from the rear surface of said support board to an opposite and distal end of each said support leg.

4. The back scrubber according to claim 1, wherein each of said plurality of support legs has a length of between 2.5 and 3.0 inches.

5. The back scrubber of claim 1, further comprising a removable and washable cloth configured to cover said scrubbing pad.

6. The back scrubber according to claim 5, wherein said removable and washable cloth is made of terry cloth.

7. The back scrubber according to claim 1, wherein said support board and said plurality of support legs are fabricated as a one-piece construction by injection molding.

8. The back scrubber of claim 1, wherein said at least one strip of hook fastening material is of industrial strength and waterproof.

9. The back scrubber according to claim 1, wherein said scrubbing pad is made of polyester fibers.

* * * * *